US005362171A

United States Patent [19]

Ritschel

[11] Patent Number: 5,362,171

[45] Date of Patent: Nov. 8, 1994

[54] SHACKLE TOGGLE JOINT FOR THE DRIVING OF WARP KNITTING EQUIPMENT

[75] Inventor: Gerd Ritschel, Heusenstamm, Germany

[73] Assignee: Karl Mayer Textilmaschinenfabrik GmbH, Obertshausen, Germany

[21] Appl. No.: 959,354

[22] Filed: Oct. 13, 1992

[30] Foreign Application Priority Data

Oct. 22, 1991 [DE] Germany ..... 4134826

[51] Int. Cl.[5] ..... D04B 27/08; D04B 23/00

[52] U.S. Cl. ..... 403/66; 403/162; 403/151; 403/69

[58] Field of Search ..... 403/161, 162, 150, 151, 403/69, 66, 78, 119; 66/208, 207, 205; 384/536, 582; 29/898.07

[56] References Cited

U.S. PATENT DOCUMENTS

| | | | |
|---|---|---|---|
| 1,187,044 | 6/1916 | Corley | 403/66 |
| 3,401,964 | 9/1968 | Johnson | 403/151 |
| 3,587,254 | 6/1971 | Kohl | 66/208 |
| 3,990,136 | 11/1976 | Hishida | 29/159.2 |
| 3,998,505 | 12/1976 | Frost et al. | 29/898.07 |
| 4,746,231 | 5/1988 | Hoshino | 384/536 |
| 4,848,938 | 7/1989 | Haas et al. | 384/536 |
| 4,908,922 | 3/1990 | Abe | 29/898.062 |
| 4,919,660 | 4/1990 | Peilloud | 403/162 |
| 4,960,334 | 10/1990 | Mazziotti | 384/536 |
| 5,208,981 | 5/1993 | Puzsik | 29/898.07 |

FOREIGN PATENT DOCUMENTS

| | | | |
|---|---|---|---|
| 0723616 | 1/1932 | France | 403/162 |

*Primary Examiner*—P. Austin Bradley
*Assistant Examiner*—Erik R. Puknys
*Attorney, Agent, or Firm*—Omri M. Behr; Matthew J. McDonald

[57] ABSTRACT

A shackle toggle joint for driving a warp knitting machine comprising a housing of synthetic material having a metal ring (13) for holding a roller bearing (16) imbedded therein. The roller bearing (16) carries a joint bolt (11). The housing (12) further comprises a securing means in the form of a threaded bore (19) for holding a connecting element. There is thus obtained a higher working life for the roller bearing and a lower level of working noise.

9 Claims, 1 Drawing Sheet

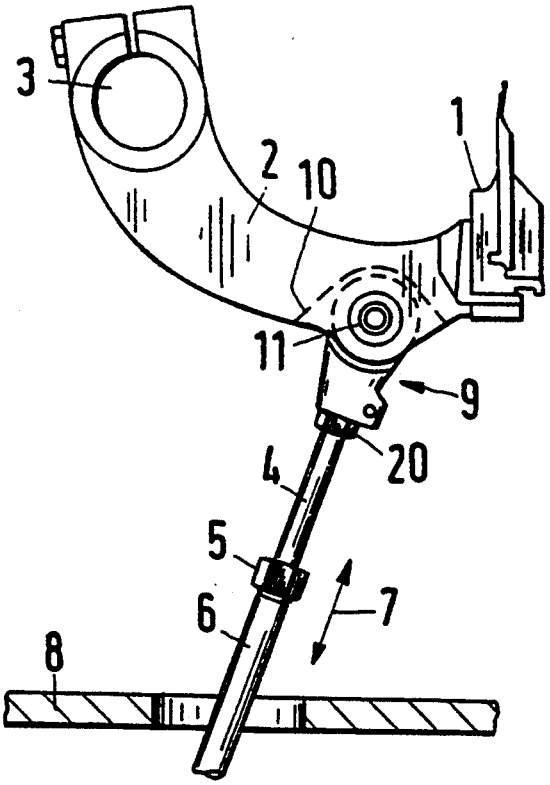
Fig.1
Fig.2
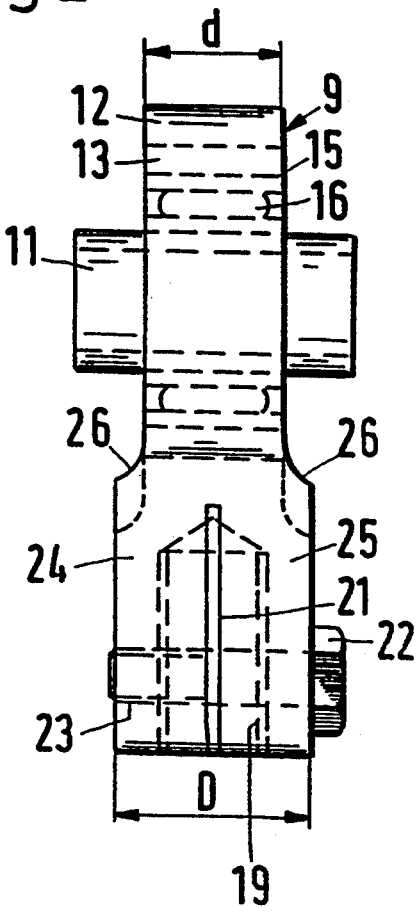
Fig.3
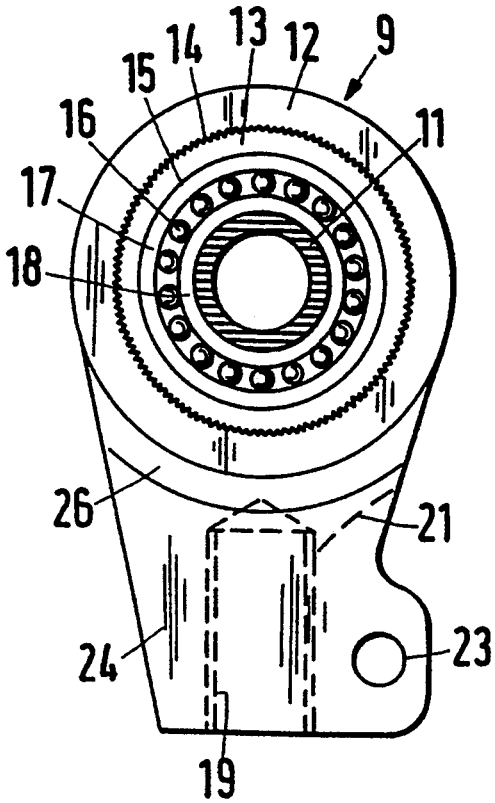

SHACKLE TOGGLE JOINT FOR THE DRIVING OF WARP KNITTING EQUIPMENT

BACKGROUND OF THE INVENTION

The invention is directed to a shackle toggle joint for driving warp knitting equipment in a warp knitting machine, comprising a housing having (a) a transverse opening therein for the acceptance of a roller bearing carrying a hinge pin and (b) a retaining means for the attachment of a connecting element thereto.

An example of a known shackle toggle joint is contained in the warp knitting machine model no. HKS 2 of Applicants' assignee. In this apparatus the housing of the shackle toggle joint is forged aluminum. The outer raceway of a roller bearing is pressed into the transverse opening of the forging. The shackle toggle joint is hinged, for example, inside a slot in a rocker arm which carries a needle bar, or other warp knitting machine apparatus. A hinge pin mounted within the roller bearing is attached to the body of the rocker arm on opposite sides of the slot in the rocker arm.

SUMMARY OF THE INVENTION

An object of the present invention is to increase the life of the components associated with a shackle toggle joint in a warp knitting machine.

In a accordance with the illustrative embodiments demonstrating features and advantages of the present invention, there is provided a shackle toggle joint for driving warp knitting elements in a warp knitting machine. The shackle toggle joint has a connecting element and a housing. The housing is made of plastic material and has a retaining means for attaching this housing to the connecting element. The joint has imbedded in the housing a metal ring having a transverse opening. Also included is a bearing mounted in the metal ring and a hinge pin mounted in the bearing.

By employing apparatus of the foregoing type an improved shackle toggle joint is achieved. In a preferred, joint the housing is made of a synthetic material such a plastic in which the metal ring for carrying the roller bearing is imbedded. This structure accommodates the substantial pressure forces that must be transferred via the shackle toggle joint and thus, also via the roller bearing.

These forces arise because of the high knitting machine speed, which can require 40 cycles per second, wherein the direction of motion of a rocker arm must be altered rapidly to thus cause correspondingly high acceleration and deceleration forces.

In accordance with the present invention, there is preferably provided a body of synthetic plastic material between the connecting element and the roller bearing, namely, the housing of the shackle toggle joint. This plastic body may be slightly deformed during and under the influence of the pressure forces. This small deformation is sufficient however, to reduce the peaks of the pressure forces. This in turn, leads to a substantial increase in the life of the roller bearing.

A second advantage is obtained thereby. The synthetic material of the housing operates as a damper for the transfer of sound. Sound generating and sound radiating areas are thus separated from each other to a certain extent. Thus, the warp knitting machine operates somewhat more quietly.

As a consequence of the foregoing deformability of the synthetic material, the outer raceway of the roller bearing could lack a firm base of attachment at the transverse opening. For this reason, a metal ring is rigidly anchored by being imbedded in the synthetic material of the housing and a roller bearing can be tightly fitted therein.

Molding the synthetic material around the metal ring is advantageous. In particular, a zero pressure molding leads to very secure retention and the maintenance of the desired damping properties of the synthetic material of the housing. In this respect, knurling the outer circumference of the metal ring is desirable using an appropriate pattern such as spiral splines. In this manner the metal ring can be anchored absolutely securely in the synthetic material.

Forming the metal ring from steel is particularly advantageous. Steel not only has a considerable rigidity, but also provides a long term, reliable, pressure seating for the roller bearing. As synthetic material for the housing, polyamides in particular, Polyamide PA 12 are particularly desirable, since they have the desired rigidity and also may be readily worked.

In a preferred embodiment of the invention, the housing is attached to other mechanisms by a threaded bore substantially perpendicular to the axis of the roller bearing. This bore permits generated forces to be readily transmitted to the housing.

Preferably, the housing has a slot extending laterally from the bore perpendicular to the axis of the transverse opening in the housing. Thus, the segments of the housing on either side of the slot may be squeezed together by tension forces from, for example, a screw or bolt. The diameter of the bore can be thereby slightly shrunk to achieve a very reliable retention of the threaded part of the connecting element in the bore.

In a further embodiment, the housing in the area of the roller bearing can have a thickness corresponding thereto and in the area of the bore can have a greater thickness. Thus, the segments of the housing proximate to the bore, the slot and its tensioning arrangement are appropriately strengthened.

In connection thereto, it is advantageous if the thickness transition of the housing is shoulder running in an arc concentrically around the roller bearing. This permits a substantially large angle of articulation between the connecting element and the rocker arm.

BRIEF DESCRIPTION OF THE DRAWINGS

Other objects, features and advantages of the present invention will be further appreciated by reference to the detailed description of the preferred embodiments and the accompanying drawings, wherein:

FIG. 1 is a side elevation view of a portion of a warp knitting machine showing a shackle toggle joint in accordance with principles of the present invention;

FIG. 2 is a front elevational view of the toggle shackle joint of FIG. 1, viewed from the right of that Figure; and FIG. 3 is a side elevational view of the toggle shackle joint of FIG. 1.

DETAILED DESCRIPTION OF THE PREFERRED EMBODIMENTS

A needle bar 1 is attached to the rocker arm 2, which is rotatable about an axle 3 fixed on the frame (not shown) of the knitting machine. The drive operates via a connecting element 4 in the form of a threaded rod, which is attached to a drive rod 6 by means of a nut 5.

This drive rod 6 is reciprocated within the machine housing 8 by means of an unillustrated drive, for example, a pattern cam. The linkage between the drive shaft 6 and the rocker arm 2 proceeds via a shackle toggle joint 9, which is mounted in slot 10 cut in rocker arm 2, whereby a joint bolt 11 is held in the slot 10 by the wall segments on both sides of slot 10 in rocker arm 2.

As will be seen from FIGS. 2 and 3 the shackle toggle joint 9 has a housing 12 of synthetic material suitably a polyamide. A metal ring, suitably a steel ring 13 having a generally cylindrical inside and outside, is imbedded in this housing 12. The outside of ring 13 has an external circumferential knurling 14, most suitably in the form of a toothed structure in the form of spiral splines. Consequently, molding performed at low or zero pressure can solidly embed metal ring 13 in housing 12. As used herein, knurling or a knurled surface includes splines, embossments, grooves, bumps, ridges or other means of providing an uneven surface that enhances the bonding between ring 13 and body 12.

Metal ring 13 provides a transverse opening 15 in which the roller bearing 16 is placed. Herein the outer raceway 17 of roller bearing 16 is press fitted into the transverse opening 15 while the joint bolt 11 is press seated in inner raceway 18.

A retaining means is shown herein with a threaded bore 19 for receiving connecting element 4 whose axis is perpendicular to the axis of the transverse opening 15. The threaded end of connecting element 4 is screwed into bore 19 and is secured there by a locking nut 20.

Slot 21 extends from bore 19 in a plane perpendicular to the axis of transverse opening 15. The slot 21 as illustrated in FIG. 3, extends from bore 19 to the right through the side wall of body 12. A tensioning means 22 (FIG. 2) in the form of a bolt is inserted in threaded bore 23 in body 12 to span slot 21 as illustrated in FIG. 2, so that both housing segments 24 and 25 can be pulled together and thus provide a particularly secure hold between the thread of the bore 19 and the thread of the connecting element 4.

In the vicinity of hinge pin 11, housing 12 has a breadth d, which corresponds to that of the metal ring 13 and roller bearing 16. In the vicinity of threaded bore 19 there is a greater breadth D so that relatively large clamping forces can be applied in the wall segments 24 and 25. A shoulder 26 marking the transition between thicknesses d and D extends along a circular arc concentrically around the axis of the transverse opening 15 that is somewhat outside the remaining circumferentially oriented housing 12. This orientation permits a rather large angular articulation between the connecting member 4 and the rocker arm 2.

Pressure testing of the shackle toggle joint shows that under pressure the polyamide is deformed approximately four times as much as forged aluminum. Under a maximum pressure load of 500 kilo-ponds, the aluminum housing is deformed by 0.035 mm and the polyamide housing between 0.1 and 0.2 mm, suitably by 0.140 mm. These pressure dependent deformations have substantially no effect upon the positioning of the working elements, however, in the case of the synthetic material, substantially reduce the pressure load on the roller bearings and furthermore, substantially reduce the noise of operation.

I claim:

1. A shack toggle joint for driving warp knitting elements in a warp knitting machine comprising:

a connecting element (4);

a housing (12) comprising plastic material and having a retaining means (19, 23) for attaching said housing (12) to said connecting element (4);

a metal ring (13) imbedded in said housing and having a transverse opening (15) and a knurled outer circumferential surface (14), said synthetic material of said housing (12) being molded by pouring around said metal ring (13);

a bearing (16) having an outer raceway (17) and an inner raceway (18) mounted in said metal ring (13), said outer raceway (17) being press fitted into said metal ring (13); and a hinge pin (11) mounted in said bearing (16).

2. The shackle toggle joint of claim 1 wherein the metal ring (13) is steel.

3. The shackle toggle joint of claim 2 wherein housing (12) is polyamide.

4. The shackle toggle joint in accordance with claim 3 wherein the transverse opening has an opening axis directed through said transverse opening and wherein the retaining means comprises:

a bore (19) having a longitudinal axis substantially perpendicular to the opening axis of the transverse opening (15).

5. The shackle toggle joint in accordance with claim 4 wherein said bore is threaded.

6. The shackle toggle joint of claim 5 wherein the housing (12) has a slot (21) therein located in a plane perpendicular to the opening axis and intersecting the axis of the bore, said slot (21) extending from the bore (19) to emerge laterally from the housing (12), said housing (12) having deflectable segments (24, 25) straddling said slit (21), said shackle toggle joint comprising:

a tensioning means (22) connected between said deflectable segments (24, 25) for urging them together.

7. The shackle toggle joint of claim 6 wherein the housing (12) near the bearing (16) has a thickness (d) corresponding to that of said bearing (16) and a greater thickness (D) near the threaded bore (19).

8. The shackle toggle joint of claim 7 wherein said housing has a thickness that changes at a shoulder (26) that extends in an arc concentric about said opening axis of the transverse opening (15).

9. The shackle toggle joint of claim 1 wherein the plastic material is molded about the metal ring (13).

* * * * *